United States Patent [19]

Strohbeen

[11] Patent Number: 4,483,015

[45] Date of Patent: Nov. 13, 1984

[54] COMPENSATION NETWORK FOR LOUDSPEAKERS

[76] Inventor: John Strohbeen, 160 Bergen St., Brooklyn, N.Y. 11201

[21] Appl. No.: 428,089

[22] Filed: Sep. 29, 1982

[51] Int. Cl.[3] ..... H04R 3/08

[52] U.S. Cl. ..... 381/103; 381/98; 333/28 T

[58] Field of Search ..... 381/98, 99, 100, 103, 381/96, 101; 333/28 T, 32

[56] References Cited

U.S. PATENT DOCUMENTS

| | | | |
|---|---|---|---|
| 1,693,401 | 11/1928 | Nyman et al. | 333/28 T X |
| 3,061,676 | 10/1962 | Wirth | 381/98 |
| 3,457,370 | 7/1969 | Boner | 333/32 X |
| 3,571,764 | 3/1971 | Koenigk | 381/101 |
| 3,838,215 | 9/1974 | Haynes, Jr. | 381/99 |
| 3,838,216 | 9/1974 | Watkins | 381/101 X |
| 4,039,977 | 8/1977 | Schmidt | 333/28 T X |
| 4,315,102 | 2/1982 | Eberbach | 381/99 |
| 4,419,543 | 12/1983 | Kelm et al. . | |

FOREIGN PATENT DOCUMENTS

| | | | |
|---|---|---|---|
| 55-45210 | 3/1980 | Japan | 381/99 |

*Primary Examiner*—Keith E. George

[57] ABSTRACT

Passive frequency compensation networks are disclosed which extend and smooth the base response of loudspeakers. The compensation networks include a series resonant circuit including a resistor, inductor and capacitor with the voice coil of the loudspeaker connected in parallel with the resistor and inductor. In another embodiment of the invention, a second inductor is loosely coupled to the first inductor to create a tuned transformer which eliminates ripples in the mid base response of the speaker.

2 Claims, 6 Drawing Figures

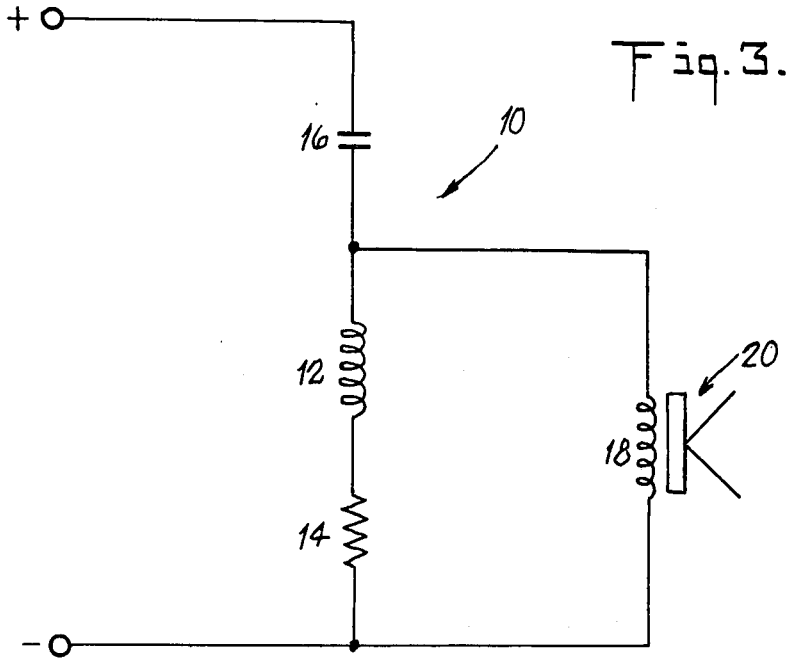
Fig. 3.
Fig. 4.
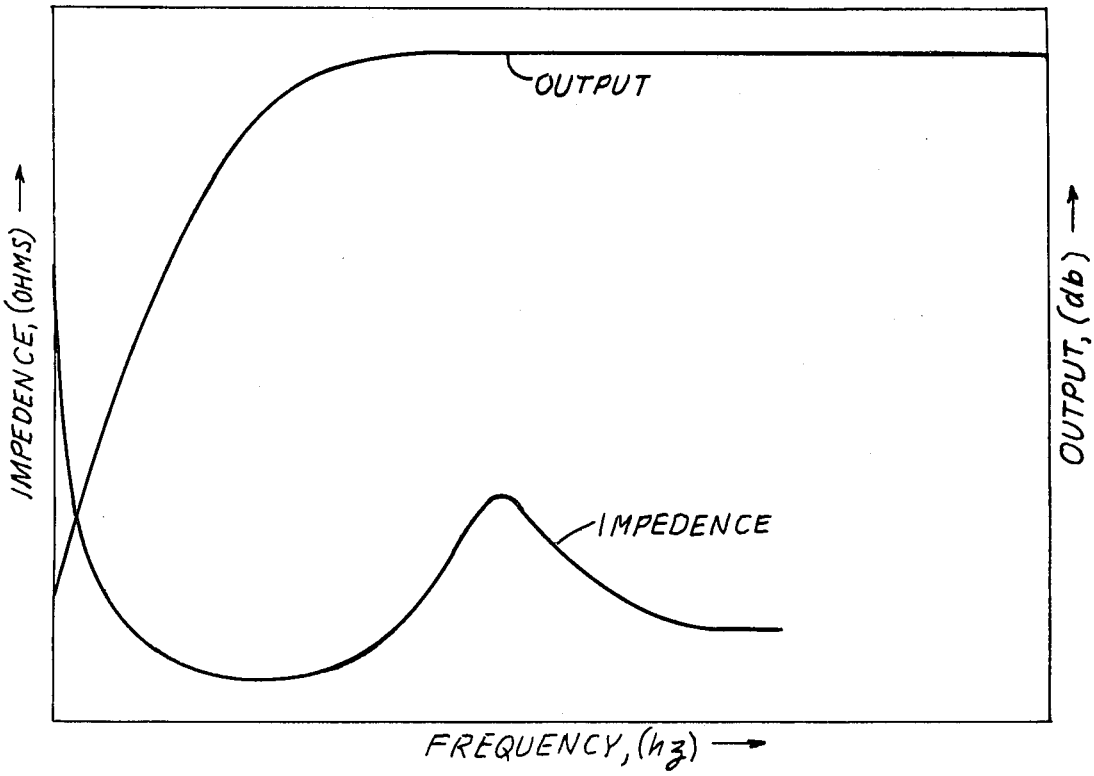

COMPENSATION NETWORK FOR LOUDSPEAKERS

The invention is directed to an improved loudspeaker system and in particular to loudspeaker systems having extended and smooth base response.

A major design goal of any high fidelity loudspeaker system is the optimization of the flattest and deepest base response. For any given loudspeaker system, whether sealed or vented, there is an optimum cabinet volume for the smoothest base response. In general, as the efficiency of the loudspeaker is increased, the volume of the cabinet required to achieve the optimum base response increases as well. This relationship between speaker efficiency and cabinet volume has been summarized in the past by the statement that there is no such thing as a small, efficient loudspeaker with deep base response.

Loudspeaker cabinets can be designed as either completely sealed or vented. The vented design includes an opening or vent in the loudspeaker cabinet, generally in the rear of the cabinet, and uses the rear end of the woofer output which is normally lost inside the enclosure of a sealed loudspeaker system to augment the sound radiated from the front of the loudspeaker. In general, vented loudspeaker systems can be designed to be smaller than sealed systems of the same efficiency, or give deeper base response when used with higher efficiency speakers in a cabinet of the same volume.

After optimizing the volume of the cabinet, and tuning for the flattest, most-extended base response, if the efficiency of the loudspeaker is increased, the output of the loudspeaker will increase in the middle and high frequencies but will remain approximately constant in the deep base. Ordinarily, the efficiency of the loudspeaker can be increased by either: (1) including more of the magnet or more of the voice coil in the gap, or (2) lowering the resistance of the voice coil wire.

In many loudspeaker systems, it is not possible to choose the optimal cabinet volume and tuning for the deepest and smoothest base response. Vented loudspeaker systems are particularly sensitive to misalignments which result in a single moderate to large peak in the impedance of the loudspeaker system in the mid-base frequency region. These ripples in the mid-base response can and do degrade the performance of the loudspeaker system. In general, the mid-base peak in a vented loudspeaker system occurs at a known frequency at which the impedance of the speaker is high. This problem could be corrected by the use of a parallel resonant circuit tuned to the frequency of the peak and connected in series with the loudspeaker system. Such a circuit can sometimes be used to reduce a moderate peak to an acceptable level. However, it is generally not practical to build a band-stop filter of sufficient sharpness to effectively deal with this problem.

The reason that the loudspeaker exhibits a characteristic constant deep base response in spite of the increased loudspeaker efficiency can be determined from an examination of the impedance variations of the system as a function of frequency. The impedance around the resonant frequency in the low base frequency range rises as the efficiency of the loudspeaker is increased. Thus, the current available to the loudspeaker is reduced when driven by a conventional power amplifier which supplies a constant voltage to any load impedance. The increased efficiency in the loudspeaker is thus balanced by the decreased power which is drawn from the power amplifier in the very region of the frequency spectrum where more power is required.

In the past, one attempt to deal with this problem has been to include the loudspeaker in the feedback loop of the power amplifier. This, in effect, changes the amplifier from a constant voltage source to a constant current source which supplies the same current to the load impedance regardless of the value of the impedance. While this approach did overcome the problem, it requires a specially-designed loudspeaker amplifier combination which adds significantly to the cost of the system.

Another approach to overcoming this problem requires the use of a special motion-sensing coil on the loudspeaker connected to the amplifier's feedback loop. Such a system is called a "servo-controlled" loudspeaker, and is very expensive and complex.

It is therefore an object of the invention to provide a system for extending and smoothing the base response of a loudspeaker system which overcomes the problems of the prior art designs.

It is a further object of the invention to provide a loudspeaker design which does not require specially-designed loudspeaker amplifier combinations, or complex motion sensing controls.

It is a further and more specific object of the invention to provide a passive frequency compensation network coupled to the loudspeaker which functions as a quasi-current source for driving the impedance of the loudspeaker.

Another object of the invention is to improve sub-sonic performance of the loudspeaker system to protect the loudspeaker system from the detrimental effects of high-power sub-sonic drive.

It is a still further object of the invention to provide a system which will remove one or more of the ripples in the mid-base response of a loudspeaker.

In accordance with the invention, a passive frequency compensation network is coupled to the loudspeaker and generates a quasi-current source driving impedance for the loudspeaker. In a particular embodiment of the invention, the passive frequency compensation network includes a series resonant circuit including an inductor, resistor and capacitor. The series connected resistor and inductor are connected in parallel across the voice coil of a loudspeaker. The effect of this invention is to extend and smooth the low base response of the loudspeaker.

In accordance with another embodiment of the invention, a circuit is provided which extends the low base impedance and exactly tunes out an impedance peak which occurs at a frequency in the mid-base response. The circuit includes a trap coil loosely coupled to the inductor of the series resonant circuit and a capacitor coupled across the trap coil, thereby creating a tuned transformer at the desired frequency to tune out the impedance peak, thereby reducing the voltage across the loudspeaker at the frequency of interest.

By use of the invention described herein, loudspeaker systems are provided with a degree of freedom in system alignments unattainable heretofore as well as performance levels previously thought to be unattainable without very costly electronic equalizers or servo-amplifiers.

These and other features and objects of the invention will become more apparent to those skilled in the art upon the reading of the following detailed description of presently preferred embodiments of the invention when taken in conjunction with the drawings, of which:

FIG. 3 is a schematic diagram of a series resonant circuit connected to an eight ohm loudspeaker which extends and smooths the base response of the speaker in accordance with the invention;

FIG. 4 is a graph showing the acoustic output and impedance characteristic as a function of frequency for the system shown in FIG. 3;

Figure 1:
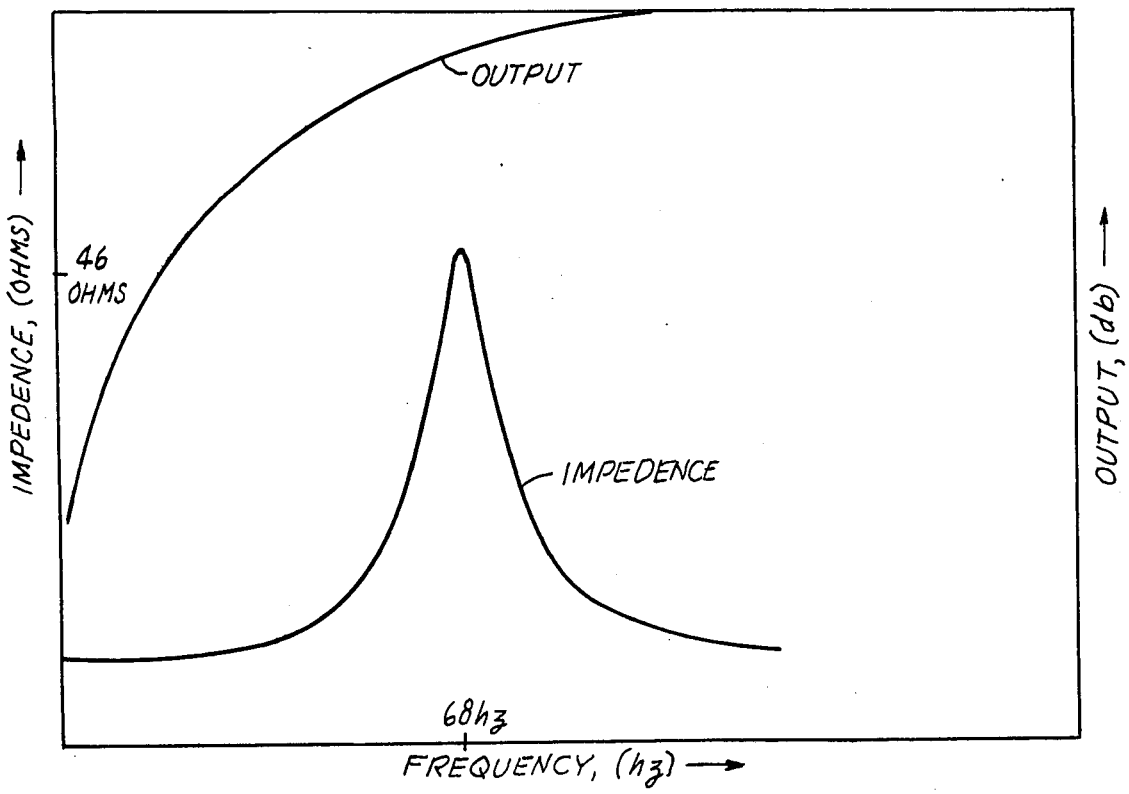
FIG. 1 is a graph showing the impedance and acoustic output variations of an eight ohm loudspeaker as a function of frequency for a typical sealed loudspeaker system.
Figure 2:
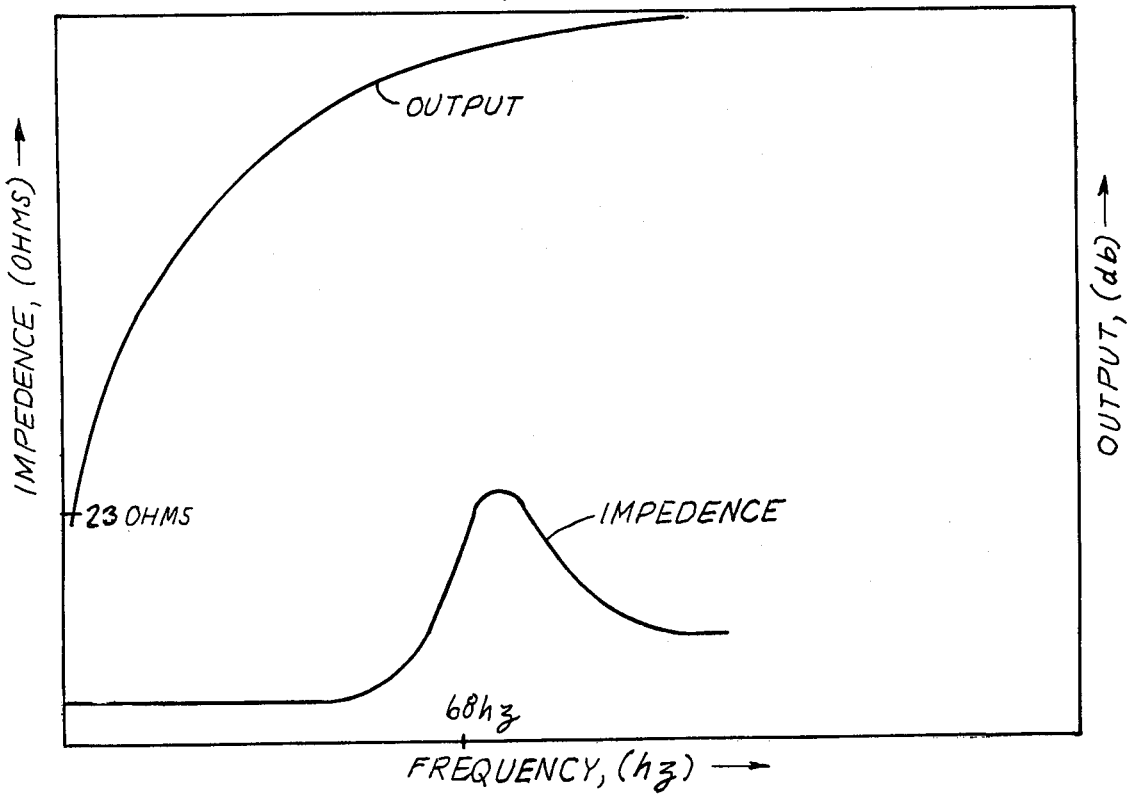
FIG. 2 is a graph showing the impedance and acoustic output of a loudspeaker as a function of frequency and illustrates the impedance characteristic which would be required to maintain constant acoustic output from the loudspeaker down to the lowest possible frequency.

With reference to FIG. 1, the variation of the impedance and acoustic output as a function of frequency of a conventional eight ohm speaker which is part of a sealed loudspeaker system is shown. As shown in FIG. 1, the speaker behaves electrically like a parallel resonant circuit tuned to 68 hertz, at which frequency the impedance peaks. Above and below that frequency, the impedance decreases toward the nominal eight ohm value. At the resonant frequency, the output of the speaker in down about 3db. Below this frequency, the base rolloff is approximately 12db per octave. FIG. 2 shows the impedance and acoustic output characteristics as a function of frequency which would be needed to maintain a constant acoustical output from the system down to the lowest possible frequency while maintaining the minimum impedance of the loudspeaker at approximately four ohms. As shown, the acoustic output is boosted below the parallel resonant frequency of the system by dropping the impedance and allowing more current to flow from the amplifier into the loudspeaker at the lower frequencies. Comparing FIG. 2 with FIG. 1, the impedance at 68 hertz as shown in FIG. 1 is 46 ohms while in FIG. 2 the impedance at 68 hertz is 23 ohms. To boost the output by 3db it is necessary only to drop the impedance to 23 ohms at this frequency, and this impedance drop is illustrated in FIG. 2. At 60 hertz, in FIG. 1, the output is down 6db. This means that the impedance must be reduced from 16 ohms, in FIG. 1, to four ohms, in FIG. 2, to achieve a constant acoustic output.

A passive frequency compensation network to achieve the impedance and acoustic output characteristics comparable to those shown in FIG. 2 is shown in FIG. 3. The network 10 is a passive series resonant circuit which includes an inductor 12, a resistor 14 and a capacitor 16. The series connected inductor 12 and resistor 14 are connected in parallel across voice coil 18 of loudspeaker 20. This circuit is in turn coupled to a conventional power amplifier (not shown) which drives the speaker. In a typical circuit, inductor 12 is 33 millihenrys, resistor 14 is approximately three ohms, capacitor 16 is approximately 750 microfarads and loudspeaker 20 is an eight ohm woofer.

FIG. 4 is a graph showing the impedance characteristics and acoustic output as a function of frequency for a speaker using the passive frequency compensation network of FIG. 3 and having the specific component values set forth above. As can be seen, the actual performance as shown in FIG. 4 correlates well with the theoretical performance shown in FIG. 2. An additional feature of the compensating network of the invention, which is shown in FIG. 4, is the rapid increase in impedance and the attendant reduction of drive to the loudspeaker below 20 hertz. This is an important benefit, particularly in vented loudspeakers which can have spurious sub-sonic resonances. Loudspeakers having the compensation network of the invention are protected against high power sub-sonic drive, a leading cause of loudspeaker damage and frequency modulation distortion.

Figure 5:
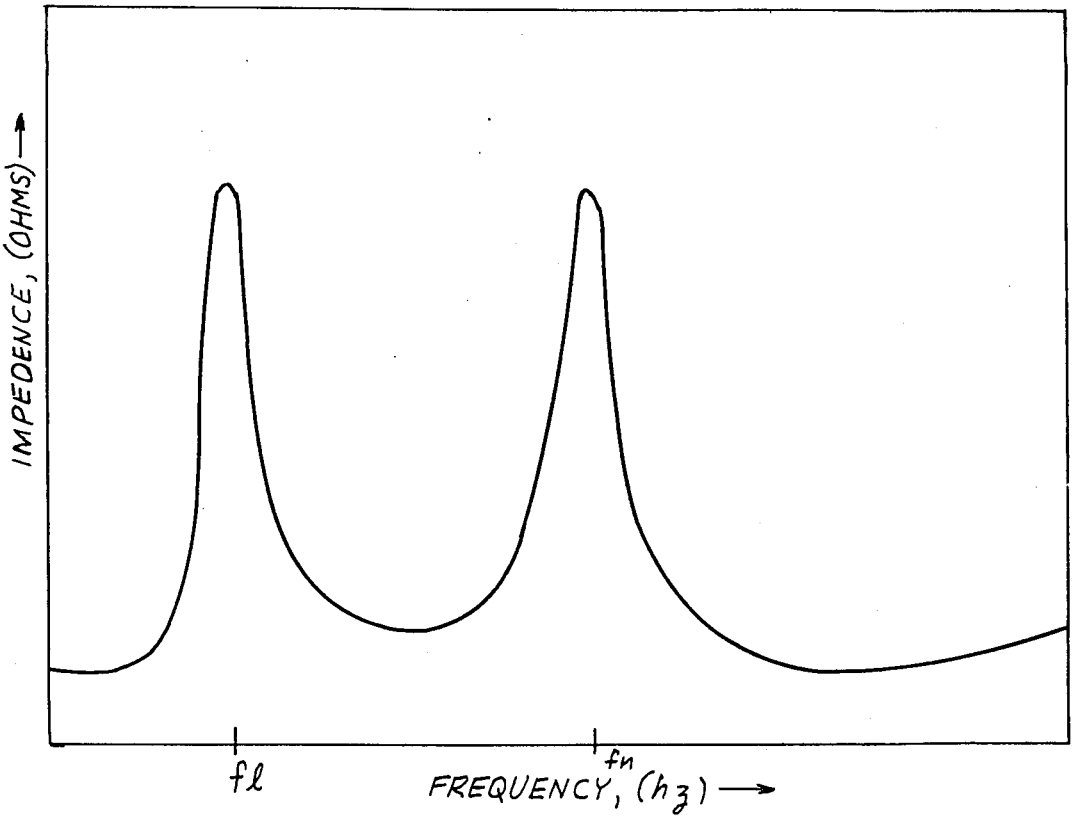
FIG. 5 is a graph showing the impedance of a loudspeaker as a function of frequency and illustrates the ripples in the mid-base response of the loudspeaker; and, FIG. 6 is a schematic diagram of a circuit which extends the low base response of the eight ohm loudspeaker and tunes out one of the ripples in the mid-base response in accordance with the invention.

In many loudspeaker designs, it is not possible to choose the optimum cabinet volume and tuning for the deepest and smoothest base response. Vented loudspeaker systems are particularly sensitive to misalignments which result in a single moderate to large peak in the base response. Although the series resonant base boost circuit shown in FIG. 3 can extend the low base response, it cannot remove ripples found in the mid-base response of the loudspeaker. FIG. 5 shows the impedance characteristic as a function of frequency of a vented loudspeaker system and shows a mid-base impedance peak which occurs generally at a frequency labeled $f_h$. In FIG. 5, the frequency of the low base impedance peak is labeled $f_l$.

Figure 6:
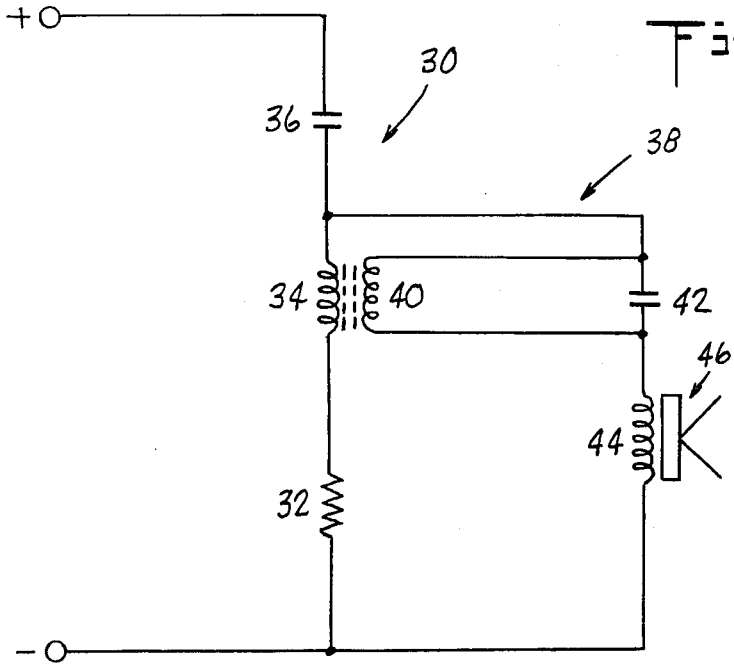

FIG. 6 shows a schematic diagram of a network in accordance with the invention which extends the low base response to the four ohm impedance limit and which exactly tunes out a 6db peak in the mid-range at frequency $f_h$.

As shown, the network 30 includes a series resonant circuit consisting of resistor 32, inductor 34 and capacitor 36 tuned to the low peak frequency $f_l$. A mid-base trap 38 includes an inductor 40 loosely inductively coupled to inductor 34 and a capacitor 42 in parallel with inductor 40. The voice coil 44 of loudspeaker 46 is coupled between capacitor 42 and resistor 32, as shown. Inductors 34 and 40 create a tuned transformer tuned to frequency $f_h$. The network 30, trap 38 and loudspeaker are connected to a power amplifier (not shown).

The tuned transformer is constructed so that the voltage across the loudspeaker at frequency $f_h$ is reduced (i.e., the primary and secondary windings are out of phase) at the resonant frequency of the trap. Thus, the apparent sharpness of the trap is multiplied by the tuned transformer operation to yield a sharp filter response.

What has been described is the presently preferred embodiments of the invention. It will be recognized by those skilled in the art that modifications and changes can be made to the invention without departing from the spirit and scope thereof which is set forth in the appended claims.

What is claimed is:

1. A system for extending and smoothing base response of a loudspeaker which has an impedance characteristic in the low base frequency range exhibiting a first impedance peak at a first particular frequency and a second impedance peak at a second particular frequency in the mid base frequency range, comprising:

a passive frequency compensation network including a series resonant circuit having an inductor, capacitor and resistor connected in series, said series resonant circuit being tuned to the frequency of the first impedance peak of said loudspeaker, a second inductor loosely inductively coupled to said first inductor to provide a tuned transformer tuned to the frequency of said second impedance peak in the mid base frequency range, said loudspeaker being coupled to said network whereby the impedance of the loudspeaker is effectively reduced to provide a desired acoustic output from said loudspeaker.

2. A system for extending and smoothing base response of a loudspeaker which has an impedance characteristic in the low base frequency range exhibiting a first and second impedance peak at a first and second frequency comprising: a series resonant circuit having an inductor, capacitor and resistor connected in series, said series resonant circuit being tuned to the frequency of the impedance peak of said loudspeaker, said loudspeaker being connected in parallel with the series connected inductor and resistor, and a second inductor loosely inductively coupled to said first inductor to provide a tuned transformer, said tuned transformer being tuned to the second frequency at which the speaker exhibits said second impedance peak to reduce the second impedance peak.

* * * * *